US009037060B2

(12) United States Patent
Shinagawa

(10) Patent No.: US 9,037,060 B2
(45) Date of Patent: May 19, 2015

(54) FIXING APPARATUS

(71) Applicant: CANON KABUSHIKI KAISHA, Tokyo (JP)

(72) Inventor: Akiyoshi Shinagawa, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 29 days.

(21) Appl. No.: 13/840,262

(22) Filed: Mar. 15, 2013

(65) Prior Publication Data

US 2013/0272761 A1 Oct. 17, 2013

(30) Foreign Application Priority Data

Apr. 16, 2012 (JP) ..... 2012-092801

(51) Int. Cl.
*G03G 15/20* (2006.01)

(52) U.S. Cl.
CPC ..... *G03G 15/2053* (2013.01); *G03G 15/2028* (2013.01); *G03G 15/206* (2013.01); *G03G 2215/2009* (2013.01)

(58) Field of Classification Search
CPC ..... G03G 15/2053; G03G 15/2064; G03G 2215/2029
USPC ..... 399/328, 40, 105, 263, 69
See application file for complete search history.

(56) References Cited

U.S. PATENT DOCUMENTS

| | | | | |
|---|---|---|---|---|
| 7,260,353 | B2 * | 8/2007 | Takemura | 399/329 |
| 2007/0048044 | A1 * | 3/2007 | Tokuhiro et al. | 399/329 |
| 2009/0074485 | A1 * | 3/2009 | Takada | 399/329 |

FOREIGN PATENT DOCUMENTS

| | | | | |
|---|---|---|---|---|
| JP | 2007-240622 | A | 9/2007 | |
| JP | 02011227226 | A * | 11/2011 | G03G 15/20 |

* cited by examiner

*Primary Examiner* — Roy Y Yi
(74) *Attorney, Agent, or Firm* — Canon USA Inc. IP Division

(57) ABSTRACT

With a fixing apparatus, a shape of a folded portion on the side of a pressure roller of a sliding contact sheet is folded along a shape of the pressure roller, thereby uniformizing a longitudinal pressure distribution and preventing an uneven-gloss image due to pressure reduction.

16 Claims, 9 Drawing Sheets

COMPARISON OF PRESSURE DISTRIBUTION AT LONGITUDINAL CENTRAL PORTION (CROSS-SECTION Y)

FIG.6

EVALUATION RESULTS OF SEPARATION PROPERTY AND UNEVEN GLOSS

| | FIRST EXEMPLARY EMBODIMENT | CONVENTIONAL ART | COMPARATIVE EXAMPLE |
|---|---|---|---|
| PRESSURE AT FOLDED PORTION *1 | 0.15 MPa | 0.07 MPa | 0.15 MPa |
| UNEVEN GLOSS (IMPROVEMENT DUE TO INCREASE IN PRESSURE AT FOLDED PORTION) | NONE | OCCURRED | NONE |
| PEAK PRESSURE *2 | 0.50 MPa | 0.50 MPa | 0.30 MPa |
| SEPARATION (DETERIORATION DUE TO REDUCTION IN PEAK PRESSURE) | OK | OK | NG |

*1: MAXIMUM VALUE NEAR CENTRAL PORTION OF PRESSURE ROLLER IN SHEET PASSING DIRECTION

*2: MINIMUM VALUE NEAR FOLDED PORTION ON DOWNSTREAM SIDE OF SLIDING CONTACT SHEET IN SHEET PASSING DIRECTION

FIXING APPARATUS

BACKGROUND OF THE INVENTION

1. Field of the Invention

The present invention relates to a fixing apparatus capable of fixing a toner image on a recording material. The fixing apparatus can be used for an image forming apparatus, such as a copying machine, a printer, a facsimile machine, and a multifunction peripheral (MFP) including a plurality of such machines. The image forming apparatus forms the toner image to the recording material with image formation processing, e.g., an electrophotographic process, an electrostatic recording process, or a magnetic recording process.

2. Description of the Related Art

Japanese Patent Application Laid-Open No. 2007-240622 discusses a fixing apparatus using a fixing belt for high-speed image formation. The fixing apparatus includes the fixing belt and a pressure belt facing each other. In a fixing nip between the fixing belt and the pressure belt, fixing processing is performed while the fixing nip nips and conveys a recording material.

The fixing apparatus further includes a pressure pad and a pressure roller inside the pressure belt to form the fixing nip between the pressure belt and the fixing belt. A sliding contact sheet covers the pressure pad to improve slidability to the pressure belt.

When forming the fixing nip long in a recording material conveying direction, if there is an area with large reduction in pressure between the pressure pad and the pressure roller, water vapor generated from the recording material is not suppressed in the fixing processing. That may cause uneven gloss. Therefore, it is required to prevent the occurrence of a pressure-reduction portion.

Longitudinal end portions of the pressure roller are configured to press against the fixing belt. Therefore, it is desirable to set a shape of the pressure roller that an external diameter of a longitudinal central portion is larger than that of the longitudinal end portions, that is, a positive crown shape.

When using the positive crown shaped pressure roller, in a longitudinal direction of the pressure roller, the distance between a leading edge of the sliding contact sheet and the pressure roller is longer at the end portions than that in the central portion. The pressure tends to be reduced at the end portions. As a result, that may cause the uneven gloss due to the reduction in pressure at the end portions.

In consideration of the reduction in pressure at the end portions, the distance between the leading edge of the sliding contact sheet and the pressure roller may be shorter than that compared with the conventional art. However, with such countermeasure, the leading edge of the sliding contact sheet may be pinched between the fixing belt and the pressure roller. Then, in the longitudinal direction of the pressure roller, the pressure at the central portion is rather reduced. Thus, that is not the countermeasure.

SUMMARY OF THE INVENTION

The present invention is directed to a fixing apparatus having a distance between a sliding contact sheet and a support roller as short as possible.

According to an aspect of the present invention, a fixing apparatus includes first and second rotatable members configured to fix a toner image on a recording material in a fixing nip between the first and second rotatable members, the first rotatable member including an endless belt, a roller configured to rotatably support the endless belt and press the endless belt against the second rotatable member to form the fixing nip, the roller having a diameter of a longitudinal central portion larger than diameters of longitudinal end portions within a recording material passing area, a pad provided adjacent to the roller in a recording material conveying direction and configured to press the endless belt against the second rotatable member to form the fixing nip, and a sliding contact sheet provided in such a manner to cover the pad and configured to slide contact with the endless belt in conjunction with rotation of the endless belt, the sliding contact sheet including a contactable portion contactable to the endless belt and an extended portion extended from the contactable portion via a folded portion, wherein the folded portion has a shape that longitudinal end portions are more projected toward the roller than a longitudinal central portion within the recording material passing area.

The present invention is also directed to a fixing apparatus that can suppress reduction in pressure between the sliding contact sheet and the support roller.

According to another aspect of the present invention, a fixing apparatus includes first and second rotatable members configured to fix a toner image on a recording material in a fixing nip between the first and second rotatable members, the first rotatable member including an endless belt, a roller configured to rotatably support the endless belt and press the endless belt against the second rotatable member to form the fixing nip, the roller having an external diameter of a longitudinal central portion different from external diameters of longitudinal end portions within a recording material passing area, a pad provided adjacent to the roller in a recording material conveying direction and configured to press the endless belt against the second rotatable member to form the fixing nip, and a sliding contact sheet provided in such a manner to cover the pad and configured to slide contact with the endless belt in conjunction with rotation of the endless belt, the sliding contact sheet including a contactable portion contactable to the endless belt and an extended portion extended from the contactable portion via a folded portion, wherein a fold line of the folded portion has a shape corresponding to an external shape of the roller within the recording material passing area.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

FIG. 6 illustrates an evaluation result of the fixing apparatus according to the first exemplary embodiment.

DESCRIPTION OF THE EMBODIMENTS

Various exemplary embodiments, features, and aspects of the invention will be described in detail below with reference to the drawings.

The exemplary embodiments are examples according to the present invention. However, the present invention is not limited to only the configurations according to the exemplary embodiments, and can be modified within the scope of the spirit of the present invention.

(1) Image Forming Apparatus

Figure 2:
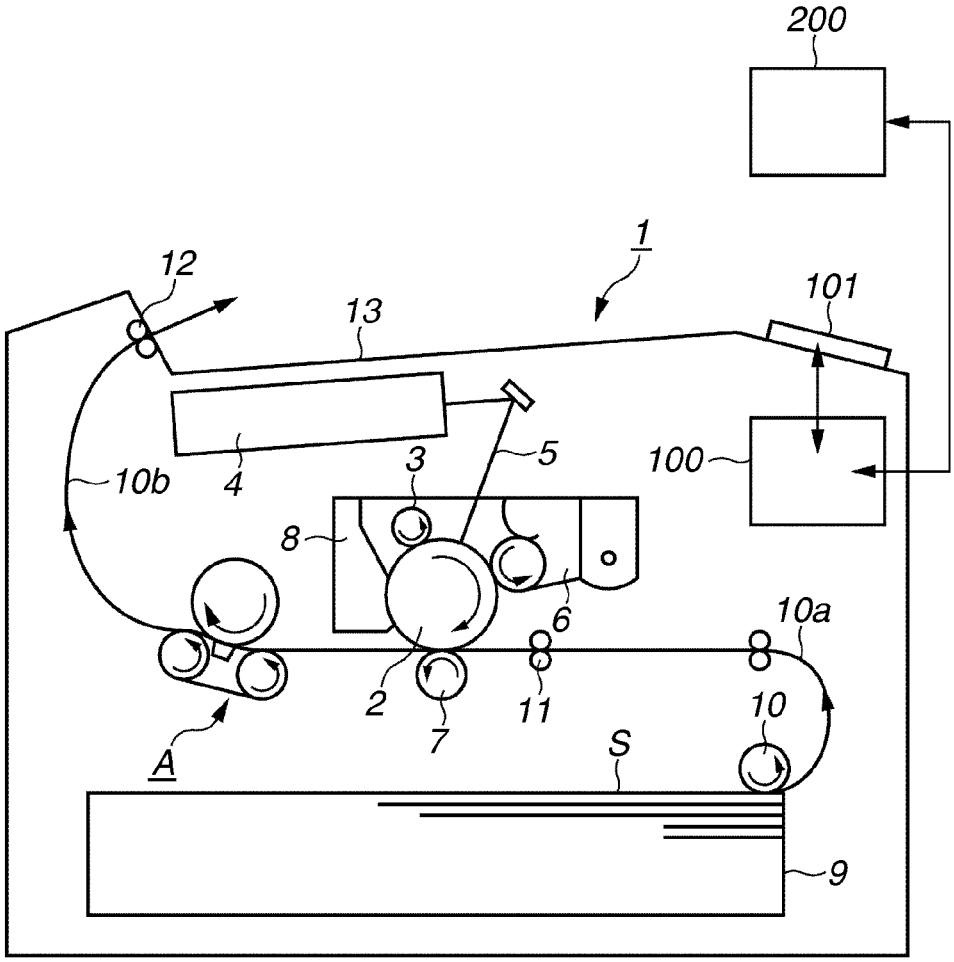
FIG. 2 is a schematic cross-sectional view illustrating a schematic configuration of an image forming apparatus according to the first exemplary embodiment.

Hereinbelow, a first exemplary embodiment of the present invention is described. FIG. 2 illustrates a schematic cross-sectional view of a schematic configuration of an image forming apparatus 1 including a fixing apparatus A as an example. The image forming apparatus 1 includes a laser beam printer using an electrophotographic process, and forms an image on a recording material S based on image information (an electrical image signal) input to a control unit (a central processing unit (CPU)) 100 from a host apparatus 200.

The control unit 100 integrally controls operations of the image forming apparatus 1, and receives and sends various electrical information signals from/to the host apparatus 200 or an apparatus operation unit (a control panel) 101. Further, the control unit 100 controls processing of the electrical information signals input from various processing devices or a sensor, processing of command signals to various processing devices, predetermined initial sequence, and predetermined image formation sequence. The host apparatus 200 includes a personal computer (PC), a network, an image reader, and a facsimile machine. The apparatus operation unit 101 is provided with a main power switch, various operation keys, and a display.

The image forming apparatus 1 includes a photosensitive drum (hereinafter, referred to as a drum) 2. The drum 2 is driven to rotate in the clockwise direction indicated by an arrow at a predetermined speed. A charger 3 uniformly charges an outer peripheral surface of the drum 2 with a predetermined polarity and potential. A laser scanner (an exposure device or optical device) 4 performs laser scanning exposure 5 on the uniformly charged surface. As a consequence, an electrostatic latent image of the scanned and exposed image information is formed to the surface of the drum 2.

A developing device 6 develops the electrostatic latent image as an unfixed toner image (an unfixed image with a developer). A transfer unit as a contact unit between the drum 2 and a transfer roller 7 sequentially electrostatically transfers the toner image to the recording material S introduced to the transfer unit.

The recording material S is stacked and stored in a sheet feed cassette 9 at the bottom of the image forming apparatus 1. A sheet feed roller 10 is driven at a predetermined sheet feed timing. Then, a recording material S in the sheet feed cassette 9 is separated and fed, passes through a conveyance path 10*a*, and reaches a registration roller pair 11. The registration roller pair 11 receives the leading edge of the recording material S and corrects a skew of the recording material S. The recording material S is fed to the transfer unit in synchronization with the toner image on the drum 2 so that the leading edge of the recording material S reaches the transfer unit when a leading end portion of the toner image on the drum 2 reaches the transfer unit.

The recording material S passing through the transfer unit is separated from the surface of the drum 2, and conveyed to the fixing apparatus A. The fixing apparatus A fixes the unfixed toner image on the recording material S to a surface of the recording material S as a fixed image with heat and pressure. The recording material S is conveyed, via a conveyance path 10*b*, to be discharged by a discharge roller pair 12 to a discharge tray 13 at the top of the image forming apparatus 1. A cleaning device 8 removes and cleans a residual sticking substance, such as a residual transfer toner, on the surface of the drum 2 after the separation of the recording material S, and is iteratively used for image formation.

An apparatus mechanical unit corresponding to an operation that the recording material S reaches the fixing apparatus A is an image forming unit for forming the unfixed toner image on the recording material S.

(2) Fixing Apparatus A (2-1) Entire Schematic Configuration of Fixing Apparatus

Figure 1A:
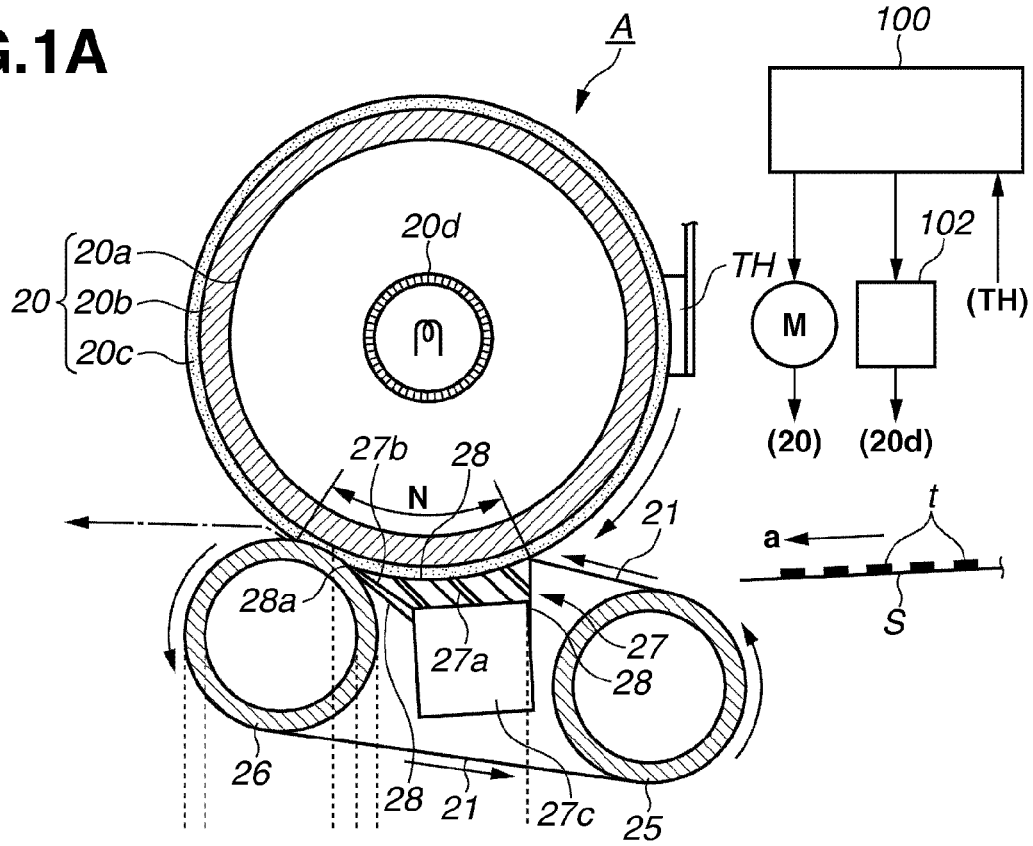
FIG. 1A is a schematic cross-sectional view illustrating a configuration of a fixing apparatus according to a first exemplary embodiment of the present invention.
Figure 1B:
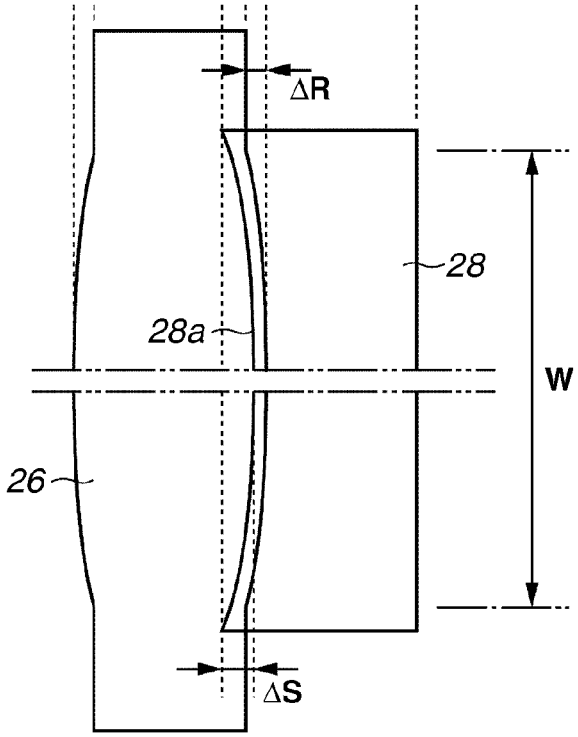
FIG. 1B is a schematic plan view illustrating a positive crown shaped pressure roller and a sliding contact sheet in the fixing apparatus with omission of longitudinal central portions.

FIG. 1A is a schematic cross-sectional plane view illustrating the fixing apparatus A. FIG. 1B is a schematic plan view illustrating a positive crown shaped pressure roller 26 and a sliding contact sheet 28 with omission of longitudinal central portion thereof in the fixing apparatus A.

According to the present exemplary embodiment, the fixing apparatus A uses a belt type fixing method (a belt type nip method). The fixing apparatus A includes a fixing roller (a fixing rotatable member) 20 of two rotatable members and a pressure belt (a pressing rotatable member) 21 facing each other and forming a fixing nip (a nip) N.

The fixing roller 20 is a complex-layer roller that is formed by sequentially laminating an elastic layer 20*b* and a release layer 20*c* to an outer peripheral surface of a core 20*a*. The core 20*a* is a hollow roller with an external diameter of 40 mm and an inner diameter ranging from 36 mm to 39 mm, and made of metal such as aluminum. The elastic layer 20*b* is made of, e.g., silicone rubber (e.g., JIS-A hardness of 20° and thermal conductivity of 0.8 W/mK) with a thickness of 300 μm. The release layer 20*c* is made of, e.g., fluoro plastic (e.g., perfluoroalkoxy (PFA) or polytetrafluoroethylene (PTFE)) with a thickness of 50 μm.

Both of the end portions of the fixing roller 20 are rotatably supported between facing side plates of a fixing apparatus casing (not illustrated) via a bearing. The fixing roller 20 is driven to be rotated in the clockwise direction indicated by an arrow at a predetermined circumferential speed by a drive mechanism M including a motor and a gear train and controlled by the control unit 100.

A halogen heater 20*d* as a heat source is inserted and arranged in the hollow core 20*a*. A power supply unit 102 controlled by the control unit 100 supplies power to the halogen heater 20*d*. As a consequence, the halogen heater 20*d* is heated to internally heat the fixing roller 20 (an inner heating method).

A temperature detection element TH, such as a thermistor, is arranged on the surface of the fixing roller in contact or adjacently noncontact therewith. The temperature detection element TH detects a surface temperature of the fixing roller 20 heated by the halogen heater 20*d*, and electrical information about the detected temperature is input to the control unit 100. The control unit 100 controls an energization amount (supplied power) to the halogen heater 20*d* from the power supply unit 102 so that the electrical information about the detected temperature input from the temperature detection element TH maintains the electrical information corresponding to a predetermined fixing temperature. That is, the control unit 100 controls the surface temperature of the fixing roller 20 to the predetermined fixing temperature.

The pressure belt 21 is an endless belt that is rotatably supported by a plurality of rollers, specifically, two rollers of a tension roller 25 and the pressure roller (a separation roller) 26. When the fixing processing is performed on the recording material S having the toner image on one side, the pressure belt 21 is arranged at a side that contacts a surface opposite to the surface of the recording material S, on which the toner image is formed. Further, the pressure belt 21 includes, as a basic layer, a metallic belt having flexibility with an inner diameter of 600 mm and a thickness of 50 μm and, as a release layer, an outer peripheral surface of the basic layer is covered with fluoro plastic (e.g., PFA or PTFE) with a thickness of 30 μm.

The tension roller 25 is a hollow roller made of ferrous alloy with an external diameter of 20 mm, an inner diameter of 16 mm, and a thickness of 2 mm in the present exemplary embodiment. A silicone sponge layer may be arranged on the surface of the tension roller 25 to reduce thermal conduction from the pressure belt 21 by smaller thermal conductivity. The pressure roller 26 is a rigid roller with low slidability and made of ferrous alloy with an external diameter of 20 mm, an inner diameter of 16 mm, and a thickness of 2 mm in the present exemplary embodiment. The pressure belt 21 is hung and stretched around the tension roller 25 and the pressure roller 26.

The pressure belt 21 is arranged below the fixing roller 20. The longitudinal end portions of the pressure roller 26 are rotatably supported between side plates of the fixing apparatus casing via a bearing. The longitudinal end portions of the pressure roller 26 are pressed with predetermined pressure against the fixing roller 20 via the pressure belt 21 by a pressing mechanism. In other words, the pressure roller 26 is a rotatable roller to press the belt against the fixing roller 20 from an inner surface to form the fixing nip N.

The end portions of the tension roller 25 are rotatably supported between facing side plates of the fixing apparatus casing via a bearing. The tension roller 25 is moved and urged in a direction for applying tension to the pressure belt 21 by an urging member (not illustrated). The tension roller 25 is arranged contactlessly to the fixing roller 20 on the upstream side of the pressure roller 26 in a sheet-passing direction (a recording material conveying direction).

The pressure pad (a fixing member) 27 is arranged adjacent to the pressure roller 26 on the upstream side of the pressure roller 26 in a belt rotational direction inside the pressure belt 21. The pressure pad 27 presses the pressure belt 21 against the fixing roller 20 from the inner surface to form the fixing nip N. In other words, the pressure pad 27 presses the pressure belt 21 against the fixing roller 20.

Figure 3:
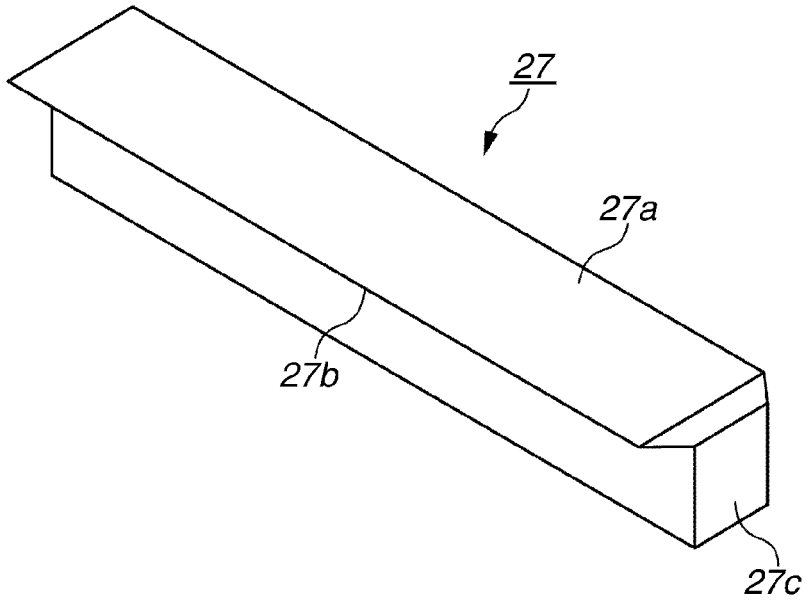
FIG. 3 is an appearance perspective view illustrating a pressure pad according to the first exemplary embodiment.

FIG. 3 is an appearance perspective view illustrating the pressure pad 27. The pressure pad 27 includes an elastic layer 27*a* made of silicone rubber (e.g., JIS-A hardness of 20° and thermal conductivity of 0.8 W/mK) with a thickness of 4 mm and formed on a metallic plate 27*c*, such as stainless steel SUS. As illustrated in FIGS. 1A and 1B and 3, the elastic layer 27*a* is shaped with a wedge projection portion 27*b* projected toward a wedge space surrounded by the pressure belt 21 and the pressure roller 26.

In the pressure pad 27, the sliding contact sheet covers a pressure pad external surface (an external surface of the fixing member) including a facing surface (a belt facing surface) of a pressure belt inner surface. This is because sliding resistance to the pressure belt inner surface is reduced. Therefore, according to the present exemplary embodiment, a low-friction sheet made of fluoro plastic (e.g., polyimide (PI) or PFA) is used as the sliding contact sheet 28. That is, a periphery of the pressure pad 27 is covered by the sliding contact sheet 28.

The pressure roller 26 and the pressure pad 27 are pressed with a predetermined pressure force (e.g., gross load of 80 kg (784 N)) against the fixing roller 20 via the pressure belt 21 by a pressing mechanism (not illustrated). The pressure belt 21 is pressed against an outer surface of the fixing roller 20 with pressure generated by the pressure roller 26 and the pressure pad 27, and the wide fixing nip N is formed in a recording material conveying direction a (FIG. 1A). In other words, the pressure pad 27 forms the continuous fixing nip N together with the pressure roller 26.

The pressure belt 21 is driven to rotate at about the same circumferential speed as that of the fixing roller rotating in the forward direction thereof. That is caused by operation of rotational torque due to frictional force, which is generated by the rotation of the fixing roller 20, with the fixing roller 20 at the fixing nip N. With the rotation of the pressure belt 21, the tension roller 25 and the pressure roller 26 are driven to rotate.

The fixing processing of the fixing apparatus A is performed as follows. The control unit 100 switches on the drive mechanism M to rotate the fixing roller 20 at a predetermined control timing. The rotation of the fixing roller 20 rotates the pressure belt 21. The control unit 100 warms up and adjusts a surface temperature of the fixing roller 20 at a predetermined fixing temperature by supplying power to the halogen heater 20*d* from the power supply unit 102 at a predetermined control timing. In this state, the recording material S that carries an unfixed toner image t from the side of the tension roller 25 is introduced to the fixing apparatus A while an image surface is upward. The recording material S is placed on the belt portion on the ascending side of the pressure belt 21, and enters the fixing nip N to be sandwiched and conveyed.

With the recording material S, the image surface that carries the toner image t is in closely contact with the surface of the fixing roller 20 while the recording material S is being pinched and conveyed through the fixing nip N. In the pinch and conveyance processing, the unfixed toner image t is heated with the fixing roller 20, pressed with nip pressure, and fixed to the surface of the recording material S as a fixed image.

A portion of the recording material S passing through the fixing nip N is sequentially separated from the surface of the fixing roller 20 to be discharged and conveyed from the fixing apparatus A. That is caused by increasing a curvature in a separation direction from the surface of the fixing roller 20 by the pressure roller 26 at an exit portion of the fixing nip N.

The recording material S is separated from the surface of the fixing roller 20 at the exit portion of the fixing nip N as follows. More specifically, a pressure distribution in the sheet passing direction a of the fixing nip N is set predeterminedly to the highest level at a pressing portion of the pressure roller 26 against the fixing roller 20. The pressure roller 26 intrudes into the elastic layer 20*b* of the fixing roller 20 against elasticity of the elastic layer 20*b* via the pressure belt 21, thereby recessing the elastic layer 20*b*.

Therefore, the pressure roller 26 increases the curvature of the portion of the recording material S passing through the fixing nip N in the direction of the recording material S separating from the surface of the fixing roller 20 at the exit portion of the fixing nip N. Thus, the pressure roller 26 sequentially separating the portion of the recording material S from the surface of the fixing roller 20.

(3) Sliding Contact Sheet

As mentioned above, a periphery of the pressure pad 27 is covered with the sliding contact sheet 28 to reduce the sliding resistance. Further, the sliding contact sheet 28 includes a folded portion (a fold line) 28*a* along a wedge projected portion 27*b* in a cross-section, which is a portion pressed against the pressure roller 26 in the elastic layer 27*a* of the pressure pad 27.

Figure 7A:
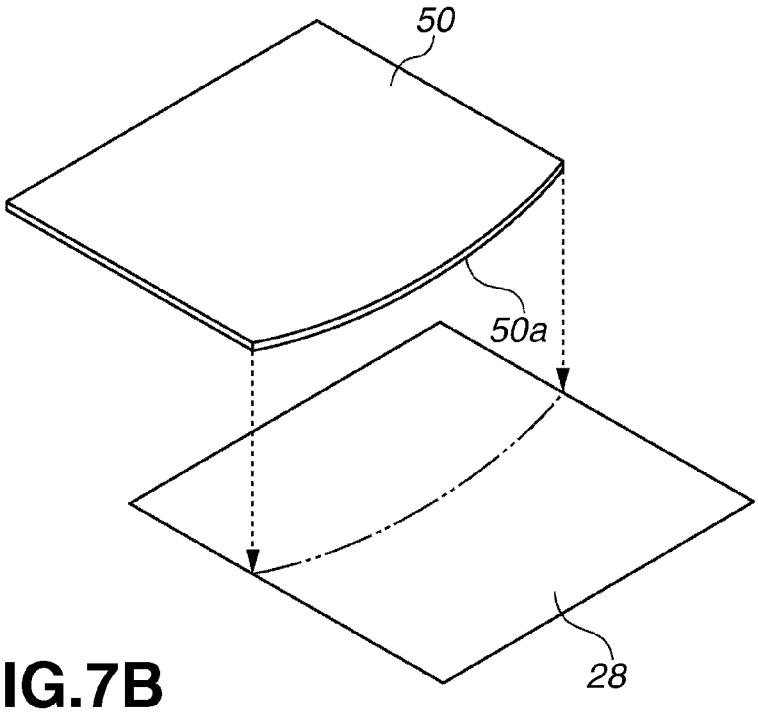
FIGS. 7A, 7B, and 7C illustrate examples of folding a sliding contact sheet according to the first exemplary embodiment.
Figure 7B:
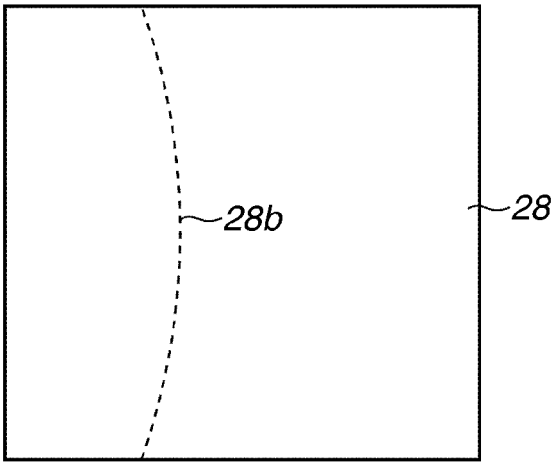
Figure 7C:
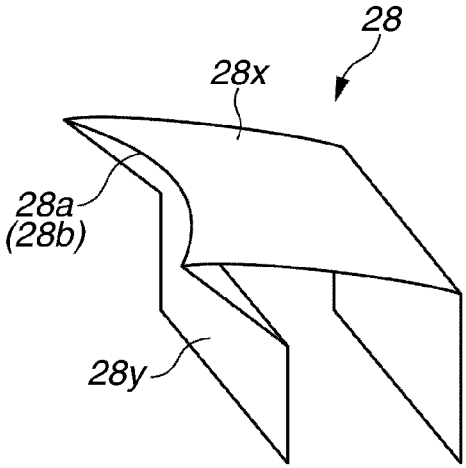

Specifically, as illustrated in FIG. 7C, the sliding contact sheet 28 includes a contactable portion 28*x* contactable to an inner surface of the pressure belt 21 and an extended portion 28*y* that is extended over the downstream side of the rotational direction the pressure belt 21 from the contactable portion 28*x* via the folded portion (the fold line) 28*a*.

The pressure roller 26 is held at the longitudinal end portions (in the axial direction), and is pressed against the fixing roller 20. Therefore, a roller with a straight shape would be bent at a longitudinal central portion, so that pressure of the pressure roller 26 is removed at the longitudinal central portion. To prevent the pressure reduction, as illustrated in the schematic diagram in FIG. 1B, the pressure roller 26 has a shape that the external diameter of the end portions is smaller than that of the longitudinal central portion by 800 μm, i.e., a positive crown shaped roller. That is, toward the end portions from the longitudinal central portion, the pressure roller 26 has a shape that the external diameter is gradually reduced.

In the fixing apparatus A including the crown-shaped pressure roller 26 and the pressure pad 27 adjacent to the pressure roller 26 and covered with the sliding contact sheet 28, an uneven-gloss image due to the pressure reduction is easily generated unless the leading edge of the sliding contact sheet 28 is shaped along the external shape of the pressure roller 26.

According to the present exemplary embodiment, the shape of the folded portion (the fold line) 28*a* of the sliding contact sheet 28 is set, within a recording material passing area W, to correspond to an external shape (the positive crown shape) of the pressure roller 26. In other words, the folded portion (the fold line) 28*a*, on the side of the pressure roller 26 of the sliding contact sheet 28, is folded along the shape of the pressure roller 26. That uniformizes the pressure distribution in the longitudinal direction and prevents the uneven-gloss image due to the pressure reduction. As a result, the surface of the extended portion 28*y* (FIG. 7C) of the sliding contact sheet 28 facing the pressure roller 26 is also shaped so that the end portions are more projected than the longitudinal central portion toward the pressure roller 26 within the recording material passing area W.

Referring to FIG. 1B, the pressure roller 26 has a positive-crown amount ΔR as a crown amount. More specifically, the pressure roller 26 has the diameter of the central portion larger than that of the end portions in a width direction (parallel to the longitudinal direction (the axial direction) of the pressure roller 26) of the recording material passing area W. The positive-crown amount ΔR is defined as the difference obtained by subtracting the radius of the end portion from the radius of the central portion. The recording material passing area W corresponds to a passing area of a recording material with the maximum width size available for the fixing apparatus A.

Similarly, a reverse-crown amount ΔS of the folded portion 28*a* of the sliding contact sheet 28 is defined as a crown amount corresponding to the positive crown amount of the pressure roller 26. The reverse-crown amount ΔS is defined as a distance from a reference line connecting the end portions of the recording material passing area W of the sliding contact sheet 28 in the width direction to the central portion of the recording material passing area W of the sliding contact sheet 28 in the width direction. In other words, the amount ΔS is defined as a difference between an end position and a central position of the sliding contact sheet 28 in the width direction, and defined so that the amount ΔS is in the same direction as that of the amount ΔR when the sign of ΔS is the same as that of ΔR.

With the definitions, the folded portion 28*a* of the sliding contact sheet 28 may be configured to satisfy $0<\Delta S<2\times\Delta R$. Hereinbelow, detailed reasons are described.

Figure 4A:
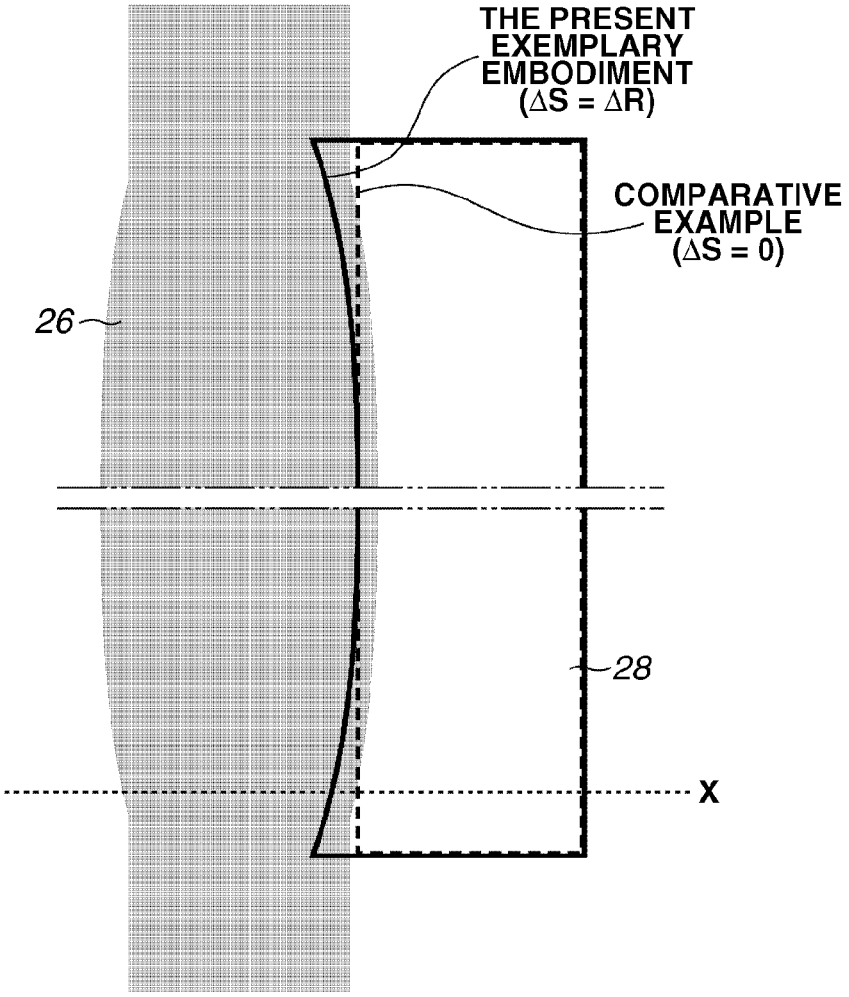
FIGS. 4A and 4B are schematic diagrams illustrating comparison between the fixing apparatus according to the first exemplary embodiment and a conventional art.
Figure 4B:
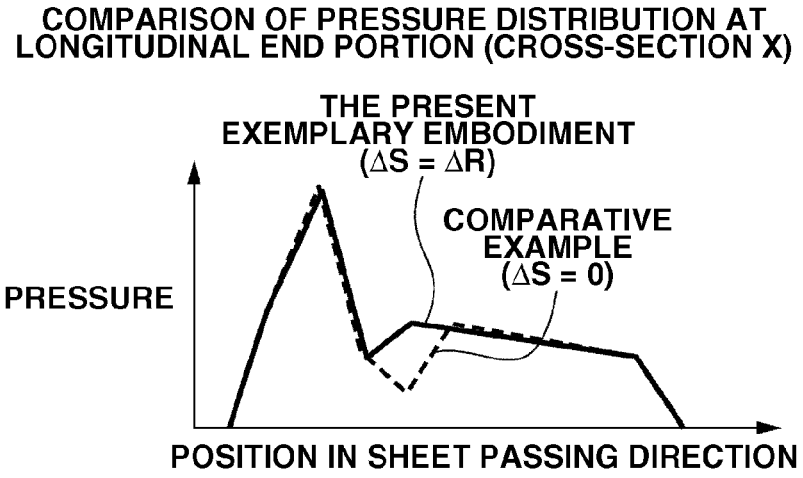

FIG. 4A is a schematic diagram illustrating comparison between the case (ΔS=ΔR) when a leading edge of the folded portion 28*a* of the sliding contact sheet 28 is aligned with the central portion thereof in the width direction according to the present exemplary embodiment, and the case (ΔS=0) according to the conventional art. FIG. 4B illustrates a pressure distribution in the X direction in FIG. 4A. The sliding contact sheet 28 is arranged close to the pressure roller 26. Therefore, with rigidity of the sliding contact sheet 28, the pressure reduction is improved near the border between the pressure roller 26 and the sliding contact sheet 28 in the sheet passing direction.

Figure 5A:
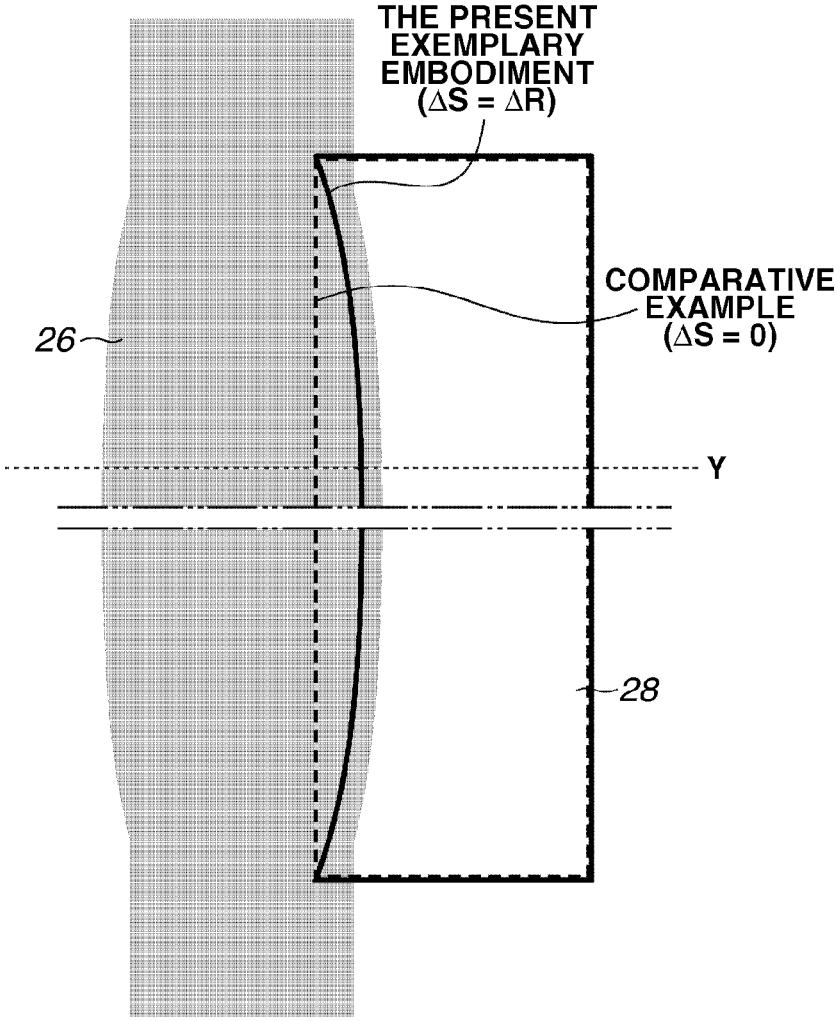
FIGS. 5A and 5B are other schematic diagrams illustrating the fixing apparatus according to the first exemplary embodiment and a comparative example.
Figure 5B:
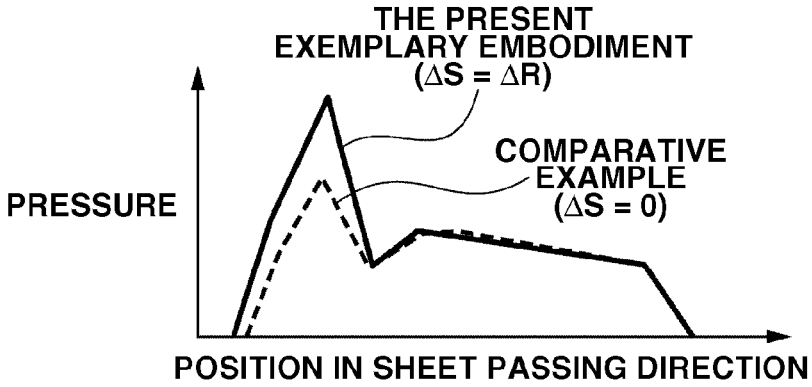

FIG. 5A is a schematic diagram illustrating comparison between the case (ΔS=ΔR) when the leading edge of the folded portion 28*a* of the sliding contact sheet 28 is aligned in the width direction according to the present exemplary embodiment, and the case (ΔS=0) when the position of the sheet folded portion is different from the conventional art as a comparative example. In this case, it is possible to prevent the pressure reduction at the longitudinal end portions in the sheet passing direction. However, as an adverse effect, the central portion in the width direction of the leading edge of the folded portion 28*a* of the sliding contact sheet 28 is pinched at a nip portion formed between the pressure roller 26 and the fixing roller 20. Thus, peak pressure drops.

FIG. 6 illustrates results of sheet separation property and the uneven gloss of the fixing apparatus A using the sliding contact sheet 28 described with reference to FIGS. 4A and 4B and 5A and 5B. Based on the results in FIG. 6, if pressure in a sheet passing direction a is low, the uneven gloss easily influences the image because water vapor is generated in the nip N.

At an exit portion of the fixing nip N, regarding the separating property of the recording material S from the fixing roller 20, the elastic layer 20*b* of the fixing roller 20 is sufficiently deformed when the peak pressure of the pressure roller 26 is high to some degree. Therefore, by increasing the curvature of the fixing roller 20 downstream of the nip, the advantage of separating the recording material S is deteriorated and the separation is difficult.

According to the present exemplary embodiment, the folded portion 28*a* of the sliding contact sheet 28 is crown-shaped to correspond to the crown shape of the external diameter of the pressure roller 26. That enables the image fixing apparatus A to prevent the pressure reduction at the end portions while maintaining the peak pressure. As a consequence, the fixing apparatus A may be advantageous to the separating property of the recording material S and the uneven gloss.

A description is given of a method for manufacturing the crown-shaped folded portion (the fold line) 28*a* of the sliding contact sheet 28. Referring to FIG. 7A, a metal plate (SUS) 50 includes a side 50*a* on the leading end side that is bent along a curve corresponding to a crown amount (ΔR=400 μm according to the present exemplary embodiment) of the pressure roller 26. Further, the metal plate (SUS) 50 is pressed against the sliding contact sheet 28 before folding with predetermined pressure, e.g., 100 N. As a consequence, a recessed portion 28*b* for easy folding is formed on the surface of the sliding contact sheet 28 indicated by a broken line in FIG. 7B.

Referring to FIG. 7C, by folding the sliding contact sheet 28 along the recessed portion 28*b*, the sliding contact sheet 28 having the sterically folded portion 28*a* can be obtained with a shape (the reverse-crown shape) that the end portions are more projected than the central portion as described in the present exemplary embodiment. The sliding contact sheet 28 covers the pressure pad 27.

Figure 8A:
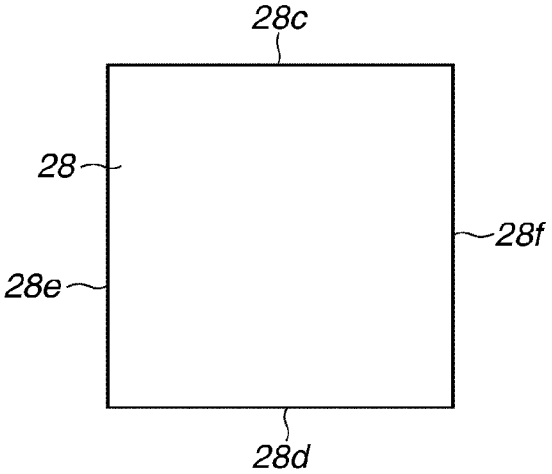
FIGS. 8A, 8B, 8C, 8D, 8E, and 8F illustrate other examples of folding the sliding contact sheet according to the first exemplary embodiment.
Figure 8B:
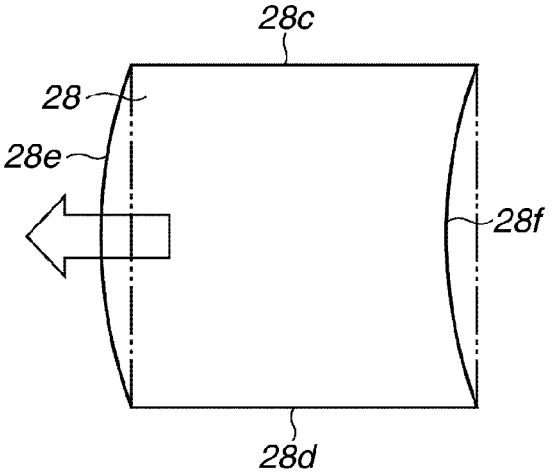

As another method, referring to FIG. 8A, two facing sides 28*c* and 28*d* (end portions) of the sliding contact sheet 28 before folding are fixed to a base surface (not illustrated). Referring to FIG. 8B, of two facing sides 28*e* and 28*f* on the unfixed side, a central portion of the side 28*e* is pulled out and bent by 400 μm to the front side against the elasticity of the sliding contact sheet 28.

Figure 8C:
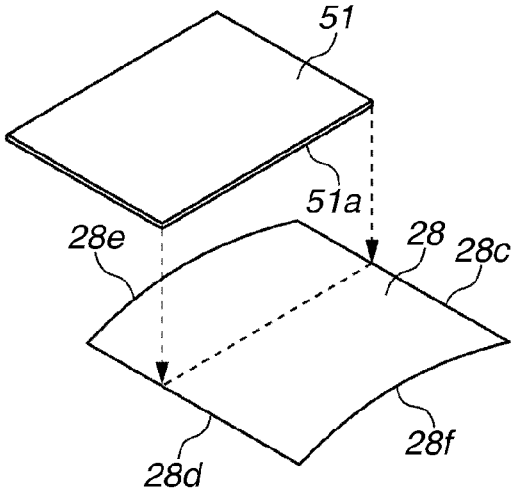
Figure 8D:
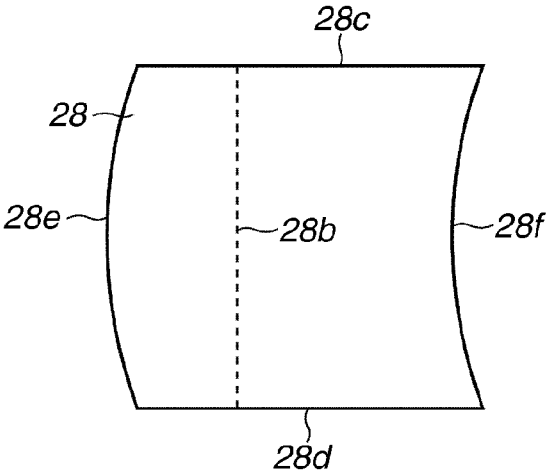

Referring to FIG. 8C, a straight side 51*a* on the leading end side of an SUS metal plate (a template) 51 with an end R of 0.5 mm is applied to the sliding contact sheet 28 in this state and is pressed by 100 N. Referring to FIG. 8D, the straight recessed portion 28*b* is provided. The recessed portion 28*b* is formed and the tension of the sliding contact sheet 28 is thereafter released. Then, the straight recessed portion 28*b* is arc-shaped by elastic return due to the release of tension of the sliding contact sheet 28, as illustrated in FIG. 8D. The release is executed to the fixing to the base surface of the two facing sides 28*c* and 28*d* of the sliding contact sheet 28.

Figure 8E:
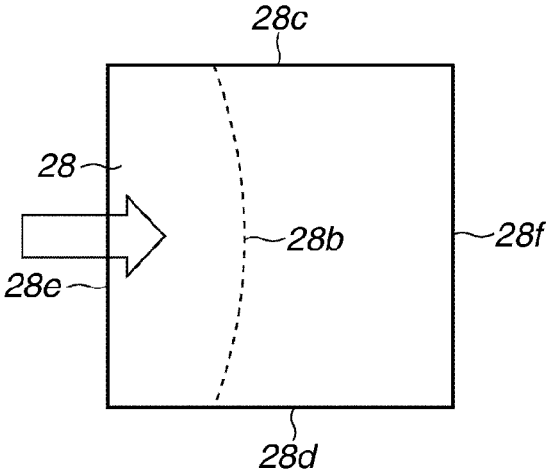
Figure 8F:
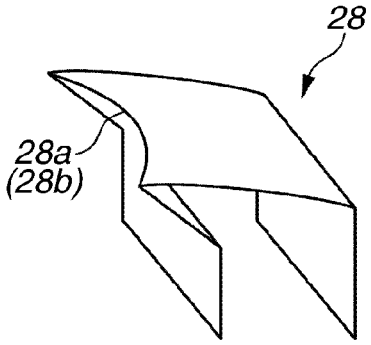

By folding the sliding contact sheet 28 along the arc-shaped recessed portion 28*b*, referring to FIG. 8E, the sliding contact sheet 28 can be provided with the sterically folded portion 28*a* with the end portions more projected than the central portion according to the present exemplary embodiment.

Referring to FIGS. 7A, 7B, and 7C and FIGS. 8A, 8B, 8C, 8D, 8E, and 8F, the sliding contact sheet 28 is approximately square by shortening the length in the longitudinal direction to emphasize the arc-shaped recessed portion 28*b*. However, the sliding contact sheet 28 before folding is actually rectangular with dimension of, e.g., 400 mm×60 mm.

Figure 9A:
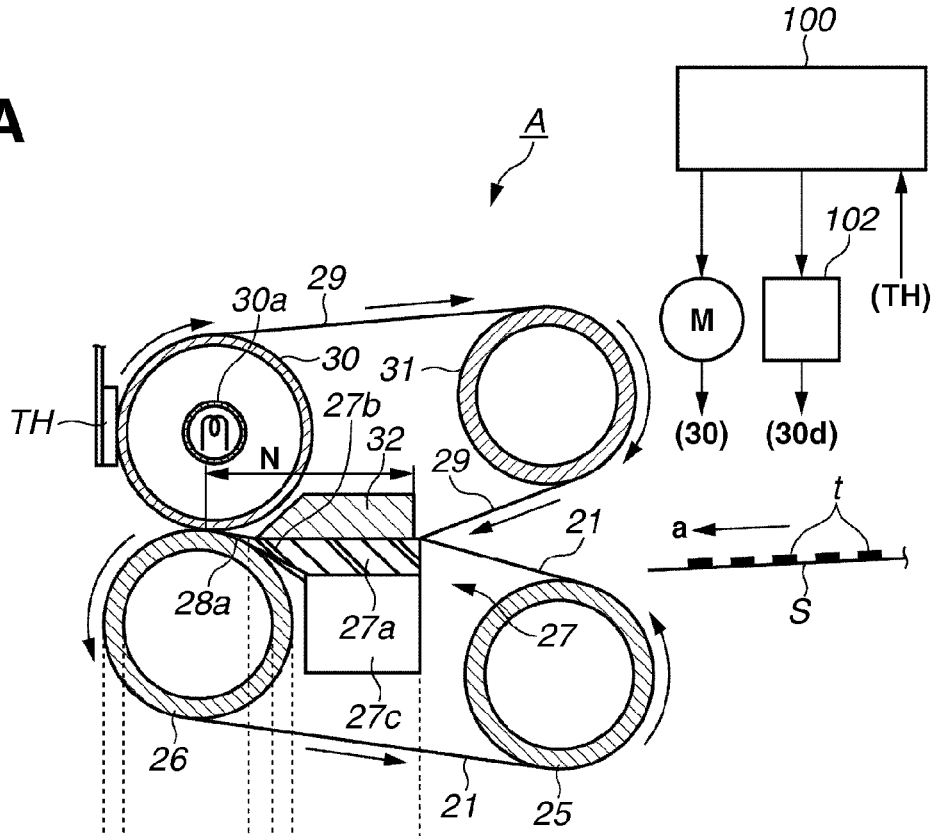
FIG. 9A is a schematic cross-sectional view illustrating a fixing apparatus according to a second exemplary embodiment.
Figure 9B:
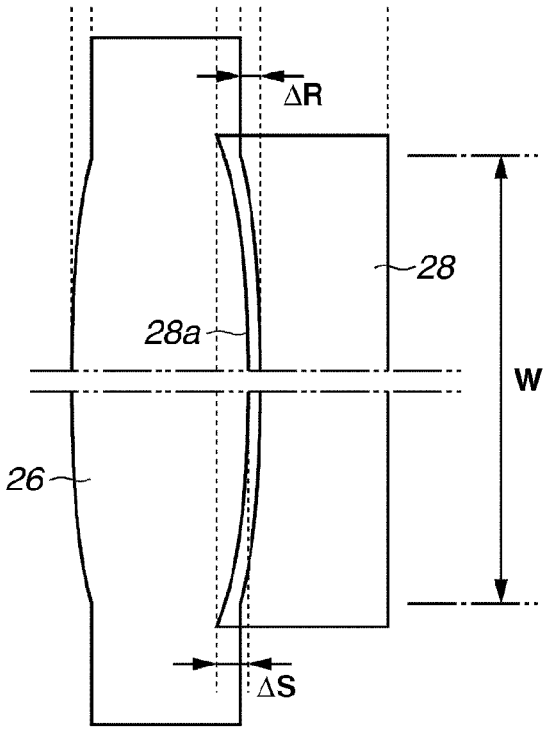
FIG. 9B is a schematic plan view illustrating a positive crown shaped pressure roller and a sliding contact sheet in the fixing apparatus with omission of longitudinal central portions.

A secondary exemplary embodiment is described. FIG. 9A is a schematic cross-sectional view illustrating a fixing apparatus A according to the present exemplary embodiment. FIG. 9B is a schematic plan view illustrating a positive crown shaped pressure roller 26 and a sliding contact sheet 28 with omission of longitudinal central portion thereof in the fixing apparatus A.

According to the present exemplary embodiment, the fixing apparatus A is a twin-belt-nip type fixing apparatus using a fixing belt 29 and a pressure belt 21 as two rotatable members facing each other and forming a fixing nip (nip) N.

A mechanical configuration of the pressure belt 21 side is similar to that including the pressure belt 21, a tension roller 25, the pressure roller 26, and a pressure pad 27 covered with the sliding contact sheet 28 in the fixing apparatus A according to the first exemplary embodiment.

A fixing belt 29 is an endless belt rotatably supported around a plurality of rollers, that is, two rollers of a fixing roller 30 and a tension roller 31.

According to the present exemplary embodiment, the fixing belt 29 includes a flexible metallic belt with an inner diameter of 500 mm and a thickness of 65 μm as a basic layer. Specifically, the fixing belt 29 is a complex-layer belt. That is, an elastic layer (e.g., JIS-A hardness of 30° and thermal conductivity of 1.0 W/mK) is formed with a thickness of 400 μm on an outer peripheral surface of the basic layer. Further, a release layer made of fluoro plastic (e.g., PFA or PTFE) with a thickness of 40 μm is formed on an outer peripheral surface of the elastic layer.

The fixing roller 30 is rotatably supported at the end portions between side plates of a fixing apparatus casing (not illustrated) via a bearing. The fixing roller is driven to rotate in the clockwise direction at a predetermined circumferential speed by a drive mechanism M, such as a motor or a gear train, controlled by the control unit 100.

According to the present exemplary embodiment, the fixing roller 31 has a diameter of 20 mm and is formed by bonding silicone rubber (e.g., JIS-A hardness of 30° and thermal conductivity of 1.0 W/mK) with thickness of 0.5 mm to a hollow metallic roller such as SUS with an external diameter of 19 mm. A halogen heater 30*a* as a heat source is inserted and arranged in the hollow metallic roller. Power is supplied to the halogen heater 30*a* from a power supply unit 102 controlled by the control unit 100. As a consequence, the halogen heater 30*a* is heated, thereby internally heating the fixing roller 30 (an internal heating method).

The tension roller 31 are rotatably supported at end portions between facing side plates of the fixing apparatus casing via a bearing. The tension roller 31 is moved and urged in the direction for applying tension to the fixing belt 29 with an urging member (not illustrated). The tension roller 31 is arranged on the upstream side of the fixing roller 30 in a sheet passing direction a. According to the present exemplary embodiment, the tension roller 31 is a hollow metallic roller such as SUS with an external diameter of 20 mm and, alternatively, may include therein a heat pipe that longitudinally uniformizes the thermal distribution.

A fixing pad (a fixing member) 32 is arranged adjacent to the fixing roller 30 on the upstream side of the fixing roller 30 in the belt rotational direction inside the fixing belt 29. The fixing pad 32 contains metal such as SUS or aluminum.

The pressure roller 26 on the side of the pressure belt 21 and the pressure pad 27 contact the fixing roller 30 and the fixing pad 32 via the pressure belt 21 and the fixing belt 29 by a pressing mechanism (not illustrated) with a predetermined pressing force. As a consequence, the fixing belt 29 is press-contacted to the pressure belt 21, thereby forming a wide fixing nip N in the sheet passing direction a.

A fixing operation of the fixing apparatus A is as follows. The control unit 100 switches on the drive mechanism M at a predetermined control timing, thereby driving the fixing roller 30 to be rotated. With the rotation of the fixing roller 30, the fixing belt 29 is rotated. The tension roller 31 is also rotated driven by the rotation of the fixing belt 29. The pressure belt 21 is rotated in the forward rotational direction of the fixing belt 29 approximately at the same circumferential speed as that of the fixing belt 29 with rotational torque generated by frictional force to the fixing belt 29 at the fixing nip N. With the rotation of the pressure belt 21, the tension roller 25 and the pressure roller 26 are driven to be rotated.

The control unit 100 causes the power supply unit 102 to supply power with the halogen heater 30*aat* a predetermined control timing and the fixing roller 30 is heated. The fixing roller 30 is heated, thereby heating the fixing belt 29. A temperature detection element TH detects a surface temperature of the fixing belt 29 and feeds back the detected temperature to the control unit 100. The control unit 100 controls the power supplied to the halogen heater 30*a* from the power supply unit 102 and to adjust the surface temperature of the fixing belt 29 so that the feed-backed detection temperature rises and maintains a predetermined fixing temperature.

In this state, the recording material S carrying the unfixed toner image t is introduced to the fixing apparatus A from the tension roller 25 with an upward image surface. Further, the recording material S intrudes to the fixing nip N and is nipped and conveyed while being placed on the belt portion on ascending side of the pressure belt 21. The image surface of the recording material S comes into close-contact with the surface of the fixing roller 20, and is nipped and conveyed in the fixing nip N. In the nip and conveyance processing, the unfixed toner image t is heated by the fixing roller 20 and is pressed with nip pressure, so that the toner image t is fixed as a fixed image on the surface of the recording material S.

The curvature of the recording material portion passing through the fixing nip N is increased at the exit portion of the fixing nip N in the separation direction from the surface of the fixing belt 29 by the pressure roller 26. Thus, the recording material S is sequentially separated from the surface of the fixing belt 29, and is discharged and conveyed from the fixing apparatus A.

The recording material S is separated from the surface of the fixing belt 29 at the exit portion of the fixing nip N as follows. More specifically, regarding the pressure distribution at the fixing nip N in the recording material conveying direction, a predetermined value is set highest at a pressing portion of the pressure roller 26 against the fixing roller 30. The pressure roller 26 intrudes into an elastic layer of the fixing belt 29 via the pressure belt 21 against the elasticity of the elastic layer, thereby recessing the elastic layer.

Therefore, the curvature of the recording material portion passing through the fixing nip N is increased in the separation direction from the surface of the fixing belt 29 at the exit portion of the fixing nip N by the pressure roller 26. Thus, the recording material S is sequentially separated from the surface of the fixing belt 29.

It is desirable that a fold line is also given to a folded portion (a fold line) 28*a* of the sliding contact sheet 28 on the pressure pad 27 with the substantially similar shape as the external diameter shape of the positive crown shaped pressure roller 26 in the fixing apparatus A, according to the present exemplary embodiment, in FIGS. 9A and 9B using the fixing belt 29 in place of the fixing roller 20 according to the first exemplary embodiment. A description is not given to a relation between the shape of the folded portion 28*a* of the sliding contact sheet 28 and the pressure roller 26 because of being similar to that according to the first exemplary embodiment.

Similar to the pressure pad 27, the fixing pad 32 may be covered with a sliding contact sheet. In this case, if the fixing roller 30 is positive crown shaped, the sliding contact sheet covering the fixing pad 32 may include the similar configuration as that of the sliding contact sheet 28 covering the pressure pad 27.

With the apparatus configuration, a difference is reduced in the distances from the leading edge of the folded portion 28*a* of the sliding contact sheet 28 to the roller 26 between the longitudinal central portion and the end portions of the sliding contact sheet 28. Thus, it is possible to improve the pressure distribution in the longitudinal direction and further improve the separation property of the recording material and the stability of the uneven gloss.

[Others]

1) According to the first and second exemplary embodiments, the halogen heaters 20*d* and 30*a* heat the fixing roller 20 and the fixing belt 29. However, exemplary embodiments of the present invention are not limited to the heating mechanism. For example, another heating mechanism such as an induction heating mechanism may be used.

2) According to the first and second exemplary embodiments, the example of the fixing apparatus A is given of fixing the unfixed toner image formed on the recording material S. However, exemplary embodiments of the present invention are not limited to this. For example, the exemplary embodiments of the present invention may be applied to an apparatus that increases glossiness of an image by performing re-fixing processing (heating and pressing) on a toner image temporarily fixed to the recording material.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2012-092801 filed Apr. 16, 2012, which is hereby incorporated by reference herein in its entirety.

What is claimed is:

1. A fixing apparatus comprising:

first and second rotatable members configured to fix a toner image on a recording material in a fixing nip between the first and second rotatable members, the first rotatable member including an endless belt;

a roller configured to rotatably support the endless belt and press the endless belt against the second rotatable member to form the fixing nip, the roller having a diameter at a longitudinal central portion greater than diameters of longitudinal end portions within a recording material passing area;

a pad adjacent the roller in a recording material conveying direction and configured to press the endless belt against the second rotatable member to form the fixing nip; and a sliding contact sheet provided to cover the pad and configured to slide contact with the endless belt in conjunction with rotation of the endless belt, the sliding contact sheet including a contactable portion contactable to the endless belt and an extended portion extended from the contactable portion via a folded portion, wherein the sliding contact sheet is folded substantially along an external shape of the roller at the folded portion and thereby a portion of the extended portion facing the roller has a shape where longitudinal end portions are more projected than a longitudinal central portion, toward the roller, within the recording material passing area.

2. The fixing apparatus according to claim 1, wherein the pad includes a projected portion projected toward a wedge space surrounded by the endless belt and the roller, and the folded portion of the sliding contact sheet is positioned adjacent an end of the projected portion.

3. The fixing apparatus according to claim 2, wherein, within the recording material passing area, when a distance between a position of the longitudinal central portion and a position of each of the longitudinal end portions of the roller is ΔR, and a distance between a position of the longitudinal central portion and a position of each of the longitudinal end portions of the folded portion is ΔS, a relationship $0<\Delta S<2\times\Delta R$ is satisfied.

4. The fixing apparatus according to claim 3, wherein a diameter of the roller is gradually reduced from the longitudinal central portion to the longitudinal end portions, and the folded portion is shaped to gradually project toward the roller from the longitudinal central portion to the longitudinal end portions.

5. The fixing apparatus according to claim 3, wherein a part of the projected portion is arranged to press the roller via the sliding contact sheet.

6. The fixing apparatus according to claim 1, wherein the pad is arranged on the downstream side of the roller in the recording material conveying direction.

7. The fixing apparatus according to claim 1, wherein the pad is made of rubber and the sliding contact sheet is made of a fluoro plastic.

8. The fixing apparatus according to claim 1, wherein, when fixing processing is performed on a recording material, in which the toner image is formed only on one side, the endless belt is arranged to contact a surface opposite a surface on which the toner image is formed.

9. The fixing apparatus according to claim 8, wherein the first rotatable member includes an endless belt.

10. A fixing apparatus comprising:

first and second rotatable members configured to fix a toner image on a recording material in a fixing nip between the first and second rotatable members, the first rotatable member including an endless belt;

a roller configured to rotatably support the endless belt and press the endless belt against the second rotatable member to form the fixing nip, the roller having an external diameter of a longitudinal central portion different from external diameters of longitudinal end portions within a recording material passing area;

a pad provided adjacent to the roller in a recording material conveying direction and configured to press the endless belt against the second rotatable member to form the fixing nip; and a sliding contact sheet provided to cover the pad and configured to slide contact with the endless belt in conjunction with rotation of the endless belt, the sliding contact sheet including a contactable portion contactable to the endless belt and an extended portion extended from the contactable portion via a folded portion, wherein a fold line of the folded portion substantially corresponds to an external shape of the roller and thereby a portion of the extended portion facing the roller has a shape where longitudinal end portions are more projected than a longitudinal central portion, toward the roller, within the recording material passing area.

11. The fixing apparatus according to claim 10, wherein the pad further includes a projected portion projected toward a wedge space surrounded by the endless belt and the roller, and the folded portion of the sliding contact sheet is positioned adjacent to an end of the projected portion.

12. The fixing apparatus according to claim 11, wherein, within the recording material passing area, when a distance between a position of the longitudinal central portion and a position of each of the longitudinal end portions of the roller is ΔR, and a distance between a position of a longitudinal central portion and a position of each of longitudinal end portions of the folded portion is ΔS, a relationship $0<\Delta S<2\times\Delta R$ is satisfied.

13. The fixing apparatus according to claim 12, wherein a part of the projected portion is arranged to press the roller via the sliding contact sheet.

14. The fixing apparatus according to claim 10, wherein the pad is arranged on a downstream side of the roller in the recording material conveying direction.

15. The fixing apparatus according to claim 10, wherein the pad is made of rubber and the sliding contact sheet is made of fluoro plastic.

16. The fixing apparatus according to claim 10, wherein, when fixing processing is performed on a recording material, in which the toner image is formed only on one side, the endless belt is arranged to contact a surface opposite a surface on which the toner image is formed.

* * * * *